US011149960B2

(12) United States Patent
Gress et al.

(10) Patent No.: US 11,149,960 B2
(45) Date of Patent: Oct. 19, 2021

(54) EXHAUST HOOD ENERGY RECOVERY DEVICE

(71) Applicant: ProGress Industries LLC, York, PA (US)

(72) Inventors: William Gress, York, PA (US); David J. Gress, Latrobe, PA (US)

( * ) Notice: Subject to any disclaimer, the term of this patent is extended or adjusted under 35 U.S.C. 154(b) by 192 days.

(21) Appl. No.: 16/734,492

(22) Filed: Jan. 6, 2020

(65) Prior Publication Data

US 2020/0232650 A1 Jul. 23, 2020

Related U.S. Application Data

(60) Provisional application No. 62/794,287, filed on Jan. 18, 2019.

(51) Int. Cl.
*F24C 15/20* (2006.01)
*F28D 15/02* (2006.01)

(52) U.S. Cl.
CPC ..... *F24C 15/2042* (2013.01); *F24C 15/2035* (2013.01); *F28D 15/0275* (2013.01)

(58) Field of Classification Search
CPC .. F24C 15/20; F24C 15/2042; F24C 15/2035; F28D 15/2075
See application file for complete search history.

(56) References Cited

U.S. PATENT DOCUMENTS

| | | | | |
|---|---|---|---|---|
| 4,122,834 | A | 10/1978 | Jacobs | |
| 4,130,111 | A | 12/1978 | Ristic | |
| 4,143,645 | A | 3/1979 | Blumberg | |
| 4,485,865 | A * | 12/1984 | McCurley | F16L 5/14 122/33 |
| 5,456,244 | A | 10/1995 | Prasser | |
| 5,687,707 | A | 11/1997 | Prasser | |
| 6,543,526 | B2 | 4/2003 | Jacobs | |
| 7,699,051 | B2 * | 4/2010 | Gagas | F24C 15/2028 126/299 D |
| 9,726,381 | B1 | 8/2017 | Prasser et al. | |
| 2003/0042012 | A1 * | 3/2003 | Pearson | F24F 11/0001 165/210 |
| 2009/0264060 | A1 | 10/2009 | Livchak et al. | |
| 2012/0079946 | A1 | 4/2012 | Dold | |
| 2016/0298859 | A1 | 10/2016 | Horvath | |
| 2017/0211818 | A1 * | 7/2017 | Bottaro | F28D 21/0014 |

FOREIGN PATENT DOCUMENTS

| | | | | |
|---|---|---|---|---|
| CN | 101368744 A | * | 2/2009 | F24C 15/20 |

* cited by examiner

*Primary Examiner* — David J Laux
*Assistant Examiner* — Nikhil P Mashruwala
(74) *Attorney, Agent, or Firm* — Hilary J. Summer

(57) ABSTRACT

A method and apparatus for recovering energy from exhaust air in a standard kitchen ventilation hood. One or more removeable energy recovery modules comprised of a plurality of heat pipes is mounted above the hot exhaust gases. Working fluid within the heat pipes transfers heat to the makeup air, warming it before it is returned to the kitchen.

9 Claims, 10 Drawing Sheets

EXHAUST HOOD ENERGY RECOVERY DEVICE

CROSS REFERENCE TO RELATED APPLICATIONS

This application claims benefit of priority from U.S. Provisional Patent Application No. 62/794,287 of William Gress and David James Gress filed Jan. 18, 2019, entitled EXHAUST HOOD ENERGY RECOVERY DEVICE, the entirety of which is incorporated herein by reference.

STATEMENT REGARDING FEDERALLY SPONSORED RESEARCH/DEVELOPMENT

Not Applicable

PARTIES TO A JOINT RESEARCH AGREEMENT

Not Applicable

REFERENCE TO SEQUENCE LISTING, TABLE OR COMPUTER PROGRAM

Not Applicable

FIELD OF THE INVENTION

The present invention pertains to the extraction of energy from heated gases exhausted from a kitchen ventilation hood. The recovered thermal energy may be used to rewarm the fresh makeup air returning to the kitchen.

BACKGROUND OF THE INVENTION

Commercial, industrial and institutional kitchens inherently generate large amounts of heat, harmful gases and particulate that must be cleansed from the air. The process of cooking meats and oils using deep fat fryers, cook tops, grills and other cooking devices creates an environment saturated with vaporized grease. This hot and polluted kitchen air presents a safety hazard and must be exhausted and replaced with clean air for the comfort and well-being of those within the working area.

Typically, a fan mounted within a commercial exhaust system draws fouled kitchen air from the cooking space. Fumes within the hood are forced over a grease filter where vaporized grease returns to a liquid state and falls into a drip tray. The air is then forced through a filter which captures any remaining particulate. After passing through this filtered ventilation hood, the gases are directed to the exterior of the building through a system of ducts.

Commercial ventilation hoods are capable of moving thousands of cubic feet of air per minute. The exhausted air must be replaced with makeup air to avoid negative air pressure in the cooking space which may lead to HVAC problems, back drafting of carbon monoxide, excessive grease build up, and malfunctioning equipment.

A makeup air unit, having a heating system, is typically placed on the roof of the building. In colder climates or chilly times of the year, the air must be warmed before it is returned to the cooking area. This is often accomplished by an electric coil or fuel fired heater (See e.g. U.S. Pat. No. 4,130,111 (Ristic)). Preheating of the makeup air requires a substantial amount energy; however, energy consumption can be greatly reduced by capturing and reusing the heat already present in the exhausting and condensing gases.

A number of commercial hoods use heat exchangers mounted within the path of vented cooking exhaust to salvage the energy found in the exhausting and condensing gases. In these designs, a cool working fluid within the heat exchanger returns vaporized grease to its liquid form. This condensing process is exothermic and as a result, any latent heat within the venting gas is released as the grease liquefies. Fluid within the heat exchanger, typically water, absorbs the heat both from the exhausting gases and any heat released during the phase change. The warmed working fluid within the heat exchanger can then be used to pre-heat water, generate electricity, warm an oven or pre-heat the return air. (See e.g. U.S. Pat. No. 6,543,526 (Jacobs), U.S. Pat. No. 5,687,707 (Prasser), U.S. Pat. No. 4,122,834 (Jacobs), U.S. Application 2016/0298859 (Horvath), and U.S. Application 2012/0079946 (Dold)). The problem with these designs is that they require a constant and circulating source of cool water to facilitate the condensing of the grease and heat transfer from the exhausting gas.

This need for a constant source of cool fluid can be eliminated by replacing a standard heat exchange method with a heat pipe using a self-contained and circulating refrigerant. Heat pipes are extremely efficient devices that facilitate the exchange of thermal energy. Each pipe is comprised of a tube of material having a high degree of thermal conductivity. A wick structure runs along the length of the tube interior to provide capillary action. The tube is filled with a working fluid and sealed at both ends. One end of the tube serves as the evaporation end and the opposite as the condensation end.

When the evaporation end of the heat pipe is placed within the path of warm exhausting air, the working fluid within this end transforms to a vapor phase as it absorbs the thermal energy passing over it. The vaporized refrigerant has a reduced molecular density. As a result, convection within the heat pipe along with the capillary action of the wick causes the refrigerant to move to the condensation end of the pipe.

The condensation end is placed in the path of the cool makeup air and therefore has a much lower temperature. This reduced temperature causes the refrigerant within this end to return to its liquid form, releasing latent heat during the phase change. This heat rewarms the makeup air blown over the condensation end of the heat pipes as the air is returned to the kitchen.

U.S. Application 2017/0211818 (Bottaro et al.) suggests the construction of a commercial kitchen hood having a closed heat exchanger of the heat pipe variety. The filter system described in this reference will not capture all of the exhausting grease, leading to build-up and inefficiencies in the heat exchanger as grease condenses on the heat pipes. The size, weight and configuration of the proposed heat exchanger make the unit cumbersome and difficult to remove and clean, resulting in a design that is ineffective for the heat transfer proposed.

Furthermore, the heat recovery coils in the Bottaro apparatus require their own enclosure and fan system and cannot be retrofitted to an existing commercial hood. Additionally, this application anticipates the use of a device to modify the angle of the heat pipes to vary the amount of thermal exchange, requiring the expenditure of additional energy.

There is therefore a need in the art for a compact, efficient, and modular energy recovery method and apparatus that can be readily manufactured or installed within existing commercial kitchen hoods, reducing the energy required to reheat makeup air and the need for external equipment.

BRIEF SUMMARY OF THE INVENTION

As discussed above, commercial kitchens generate large amounts of heat, harmful gases, vaporized grease, and particulate that must be cleansed from the air. In a typical commercial hood, a roof-mounted fan exhausts fouled air from the cooking area, pulling it through a filter and out to an external environment. A second fan unit, placed at a distance from the exhausting air, pulls fresh makeup air into the kitchen hood to avoid negative air pressure. A heating device within this makeup air unit rewarms this air before it is returned to the kitchen area.

The makeup air heating device typically uses a resistive element or fuel-fired mechanism and one or more fans, requiring high levels of energy to warm and redirect the air. The present invention seeks to use the energy already present in exhausting cooking air to supplement or completely replace the heating device within the makeup air unit, thereby reducing the energy cost required to warm the fresh return air.

It is well known that heat can be captured and transferred through a heat exchange device known as a heat pipe. Pressurized working fluid or refrigerant is placed within a pipe or tube and hermetically sealed at both ends. A homogenous or composite wick having a small capillary radius, high wick permeability, high thermal conductivity, and high wick porosity is placed along the length of the tube interior. When one end of the pipe is placed in an area of higher heat, the working fluid within the pipe absorbs that energy and transforms from a fluid to a vapor phase. The capillary action of the wick along with the convection within the tube draws the vapor toward the cooler end of the heat pipe. Once the vapor arrives at the cooler end, the vapor reverts to its liquid phase, releasing latent heat. If the heat pipe is made of a conductive material such as copper, the release of that latent heat can be more efficiently transferred to the surrounding environment. The addition of conductive fins to the heat pipe can further enhance that heat transfer.

The present invention comprises one or more energy recovery modules comprised of a plurality of heat pipes placed substantially parallel to one another within an enclosure having an optional handle. The design is capable of modulating the heat recovered while maintaining a constant exhaust outflow and makeup air inflow. One or more of these energy recovery modules is installed or retrofitted within an existing commercial kitchen hood or ventilation device and supported by brackets or tracks.

One end of the plurality of heat pipes within the module is placed above the hot exhausting air while the opposite ends are placed in the path of the cool return air. A baffle separates the exhausting air from the makeup air, keeping the air streams distinct and separate. As described above, hot exhaust blown through the first (evaporation) end of the heat pipes vaporizes and moves to the cooler second (condensation) end of each pipe. As the vapor cools, it reverts to its liquid form and releases latent heat. The conductive metal surrounding the fluid, transfers that heat to the makeup air that is directed through the heat pipes, thereby warming the air before it returns to the kitchen.

Heat pipes are sealed and offer a virtually endless loop of heat transfer cycles as the working fluid transforms back and forth from vapor to liquid form, respectively absorbing heat from the hot kitchen exhaust and transferring heat to the fresh return air. These pipes need no power source and require only periodic cleanings to maintain their efficiency.

As mentioned above, the energy recovery modules are comprised of a plurality of heat pipes within a compact unit. These modules can take any shape or size provided that they are elongated and can fit within the existing kitchen hood. The inventors anticipate using a plurality of smaller energy recovery modules that can be stacked on top or beside one another. The use of smaller modules allows for a more cost effective and portable unit that can be easily removed, cleaned, and exchanged. The phrase "easily removeable" as used in this patent application shall refer to an energy recovery module that can be taken out and cleaned or inspected by a single person of average size having no specialized training. The phrase "easily exchangeable" as used in this patent application shall refer to the removal and handling of at least one energy recovery module and the installation of at least one energy recovery module by a single individual of average size having no specialized training. It should be noted that the efficiency of the energy recovery will increase with the number of energy recovery modules used. More modules can be added to the hood as the need arises or as the user's budget allows.

A sliding door or hinged panel may be added to at least one side of the kitchen hood along with a means such as a track or t-bracket to support the energy recovery modules. A handle may be added to the end of each recovery module for easier removal of the units for cleaning. Alternatively, spray nozzles may also be used to clean the modules.

In order to ensure the comfort of the kitchen staff, a desired return air temperature may be selected. In milder weather or climates, less air may need to circulate within the energy recovery modules. An adjustable bypass damper having one or more blades is mounted within the path of return air to address this issue. A sensor in the makeup air unit detects the temperature of the incoming air while a second sensor located downstream of the energy recovery modules determines the temperature of the warmed air. These temperature readings are sent to a microprocessor that calculates the ideal position for the bypass damper blade(s), channeling the proper amount of air through the energy recovery module and diverting the remaining air around that module. This method requires little additional energy and maintains the balance between the supply and exhaust air, allowing the two air streams to mix and reach the desired temperature prior to exiting the hood.

REFERENCE NUMERALS

5 Kitchen Hood
10 Cooking Operation
15 Hot Exhaust
20 Air Entrance Chamber
25 Filter
30 Grease Collection Trough
35 Exhaust Chamber
40 Exhaust Fan
45 Filtered Air
50 Makeup Air Unit
55 Fresh Makeup Air
60 Supply Chamber
65 Baffle Between Hot Exhaust and Makeup Air
70 Energy Recovery Module
75 Heat Pipe
80 Baffle Lip
85 Evaporation End
90 Condensation End
95 Working Fluid
100 Heating Device
105 Bypass Damper
110 Heated Makeup Air
115 Wick
120 Actuator
125 Moveable Partition
135 Post-Mixing Chamber
140 Baffle Door
145 Sliding Door or Hinged Access Panel
150 Supporting Means
155 Handle
160 Spray Nozzle
170 Dummy Coil
175 Fins
$\alpha$ Module Installation Angle

DETAILED DESCRIPTION OF THE INVENTION

Figure 1:
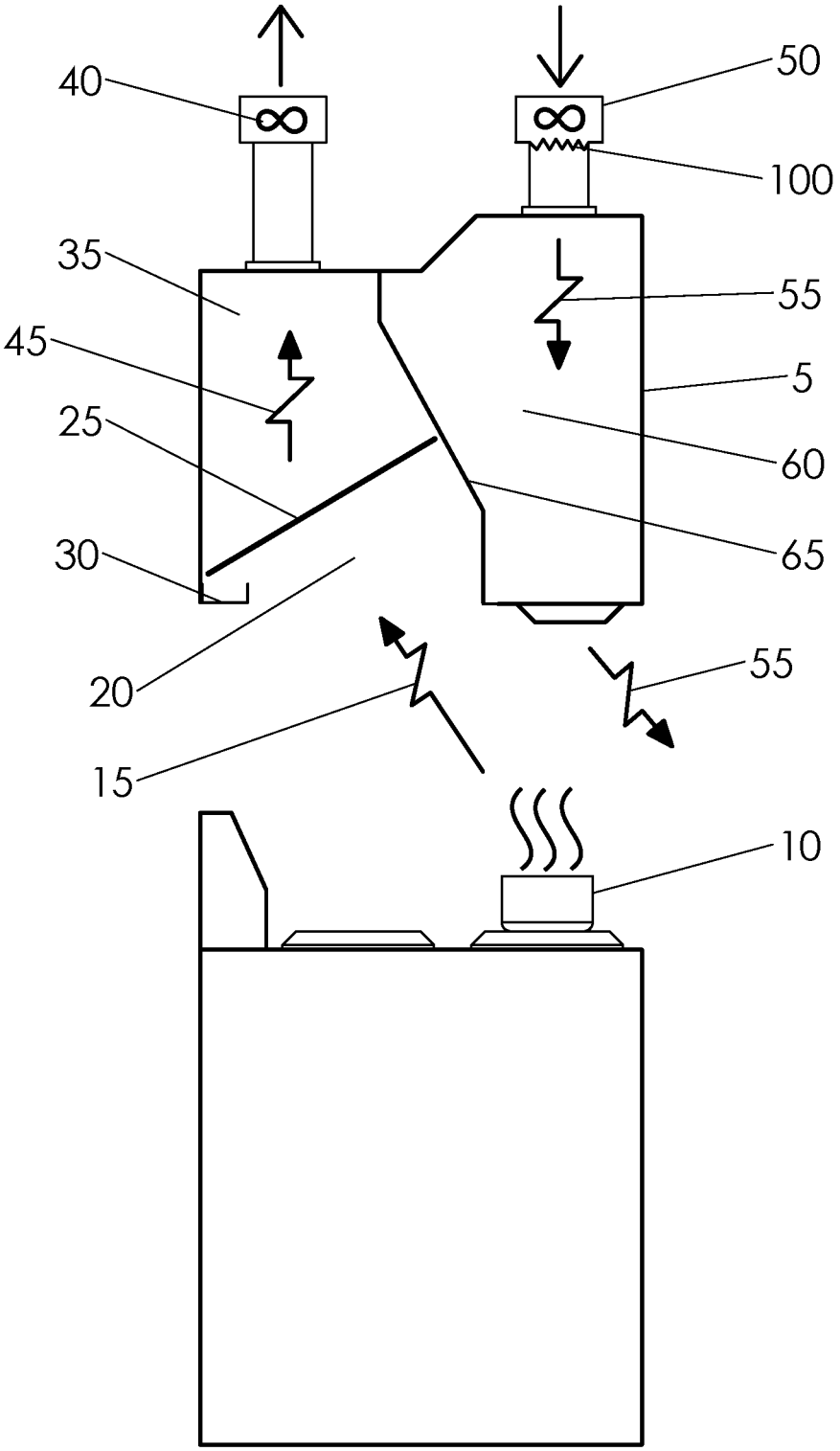
FIG. 1 is an elevational side view of a standard commercial cooking operation and ventilation hood

FIG. 1 illustrates a typical commercial kitchen hood 5 positioned above a cooking operation 10. In this design, hot exhaust 15 from the cooking operation 10 is drawn into the air entrance chamber 20 and through a filter 25. Excess grease drips from the filter 25 into a grease collection trough 30 while the filtered air 45 passes into the exhaust chamber 35 of the hood 5. An exhaust fan 40, creates the draft, drawing the filtered air 45 to the exterior while a makeup air unit 50 delivers fresh makeup air 55 to the supply chamber 60 of the hood. A baffle 65 separates the hot exhaust 15 and filtered air 45 from the fresh makeup air 55. The baffle 65 may be placed at any point within the kitchen hood 5 provided that the design creates acceptable air velocity flows for each air stream.

Oftentimes the fresh makeup air 55 must be heated before it is returned to the cooking area. This is typically done with heating device 100 within the makeup air unit 50. The present invention seeks to use the energy already present in hot exhaust 15 to replace or supplement the heating device 100 within the makeup air unit 50, thereby reducing the energy cost required to warm the fresh makeup air 55.

Figure 2A:
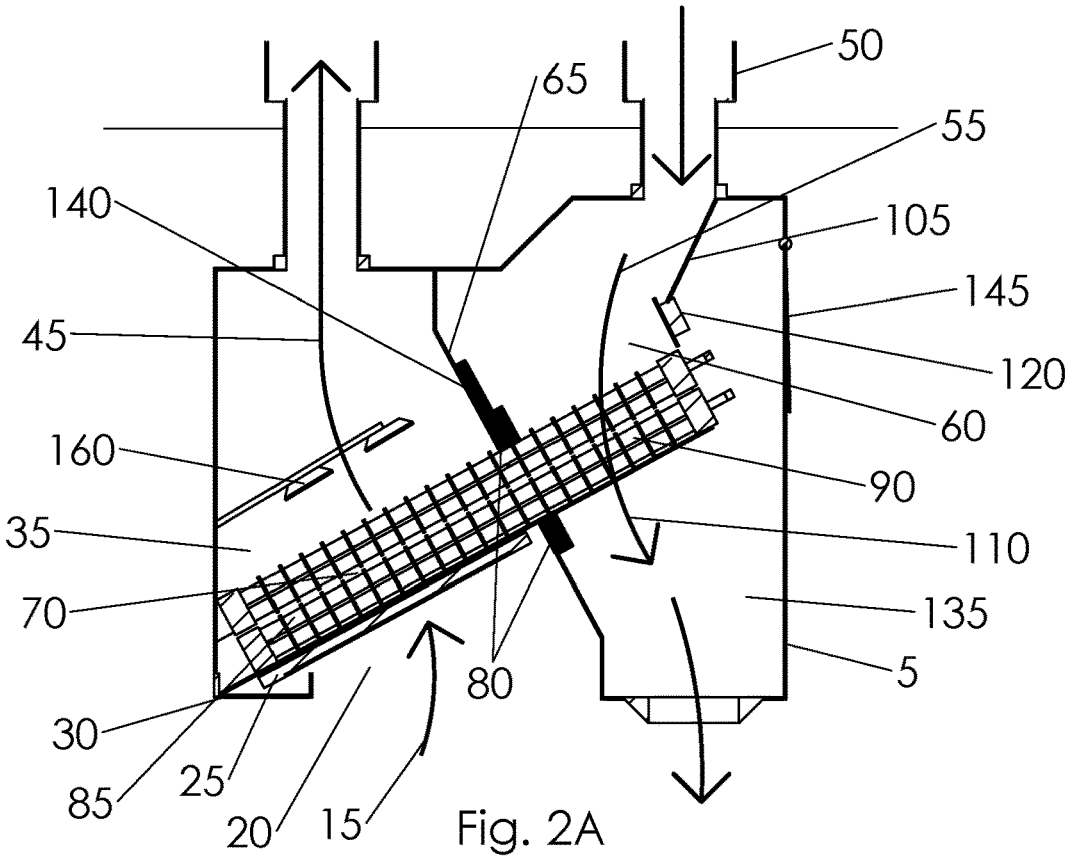
FIG. 2A is an elevational side view of the present invention showing the airflow in winter mode and the access door closed
Figure 2B:
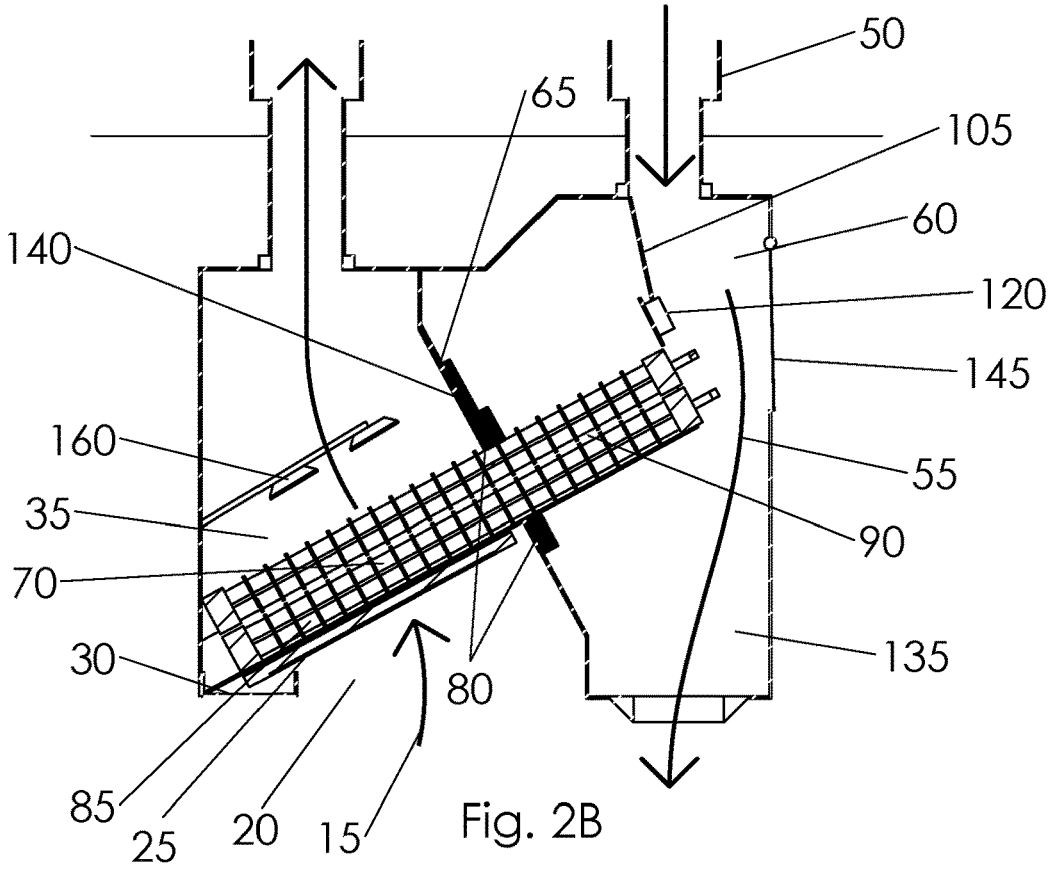
FIG. 2B is an elevational side view of the present invention showing the airflow in summer mode and the access door closed
Figure 4:
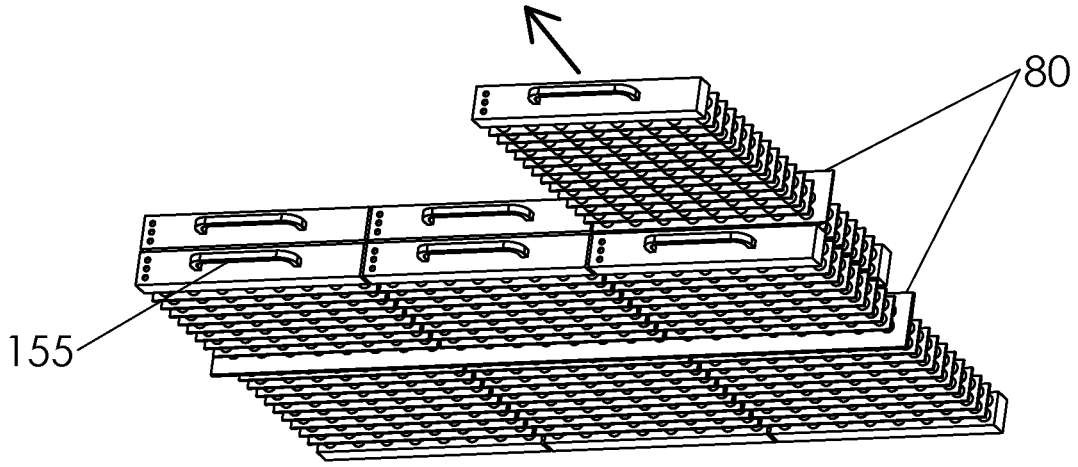
FIG. 4 is a perspective view of a plurality of energy recovery modules

Referring now to FIGS. 2A and 2B one or more energy recovery modules 70, comprised of a plurality of heat pipes 75, is positioned downstream of the filter 25 at a module installation angle $\alpha$ and through a void in the baffle 65. A baffle lip 80 on the energy recovery module 70, or alternatively a gasket, may be used to prevent leaks in the baffle 65 as shown in FIGS. 2A, 2*b* and 4. Each heat pipe 75 is comprised of an evaporation end 85 and a condensation end 90. The hot exhaust 15 passes over the evaporation end 85 of each heat pipe 75 within the energy recovery module 70.

Figure 3A:
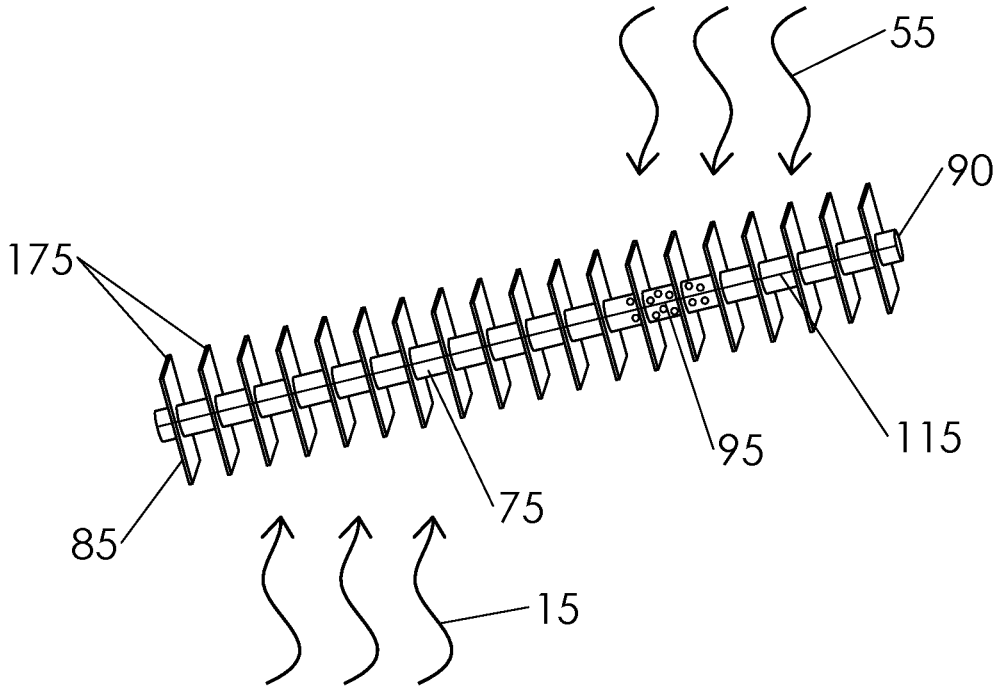
FIG. 3A is a perspective view of a single heat pipe having fins
Figure 3B:
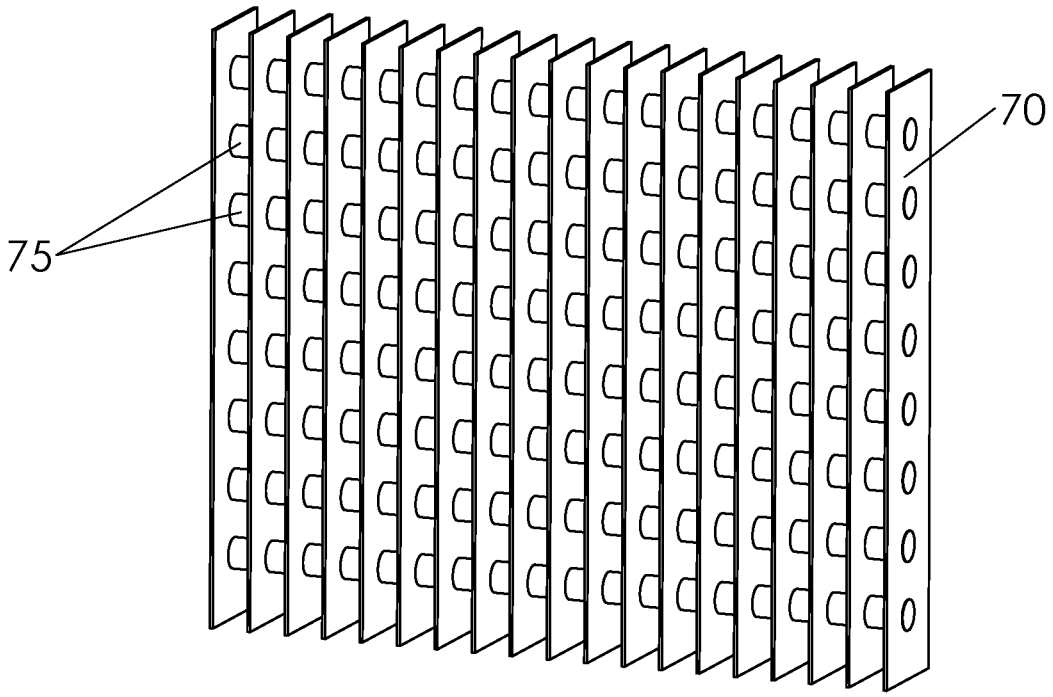
FIG. 3B is a perspective view of an energy recovery module comprised of a plurality of heat pipes

Turning now to FIGS. 3A and 3B, liquid working fluid 95 within the evaporation end 85 of each heat pipe 75 absorbs the thermal energy of the hot exhaust 15, converting this fluid to its vapor phase and reducing its density. The resulting convection causes the working fluid 95 to move toward the condensation ends 90 of each heat pipe 75 within the energy recovery module 70.

A fan within the makeup air unit 50 blows fresh makeup air 55 into the supply chamber 60 of the hood and over the condensation ends 90 of the heat pipes 75. This fresh makeup air 55 is generally cooler than the hot exhaust 15. When the working fluid 95 reaches the cooler, condensation end 90, it reverts to its liquid phase, releasing latent heat. This heat is used to warm the fresh makeup air 55, either supplementing or completely replacing the heating unit 100 in the makeup air unit 50. Fins 175 on the evaporation and condensation end of the heat pipes may also be used to promote the heat transfer between the heat pipes and the flow of air. These fins 175 are typically comprised of a thin piece of metal having a hole. The heat pipe 75 or module 70 passes through that hole as depicted in FIGS. 3A and 3B.

Ideally the fins 175 will be made from copper or aluminum and spaced such that there are three to fourteen fins per inch. Inventors contemplate the use of fins 175 that are approximately 0.006 inches to 0.010 inches thick but this thickness may vary with the material used provided that they facilitate the required amount heat transfer. Fins 175 having a rectangular shape are the most space efficient; however, it should be recognized that any number of shapes may be used.

Once the working fluid 95 has returned to a liquid state, the effect of gravity along the module installation angle $\alpha$ causes the working fluid 95 to drain back into the evaporation end 85 of each heat pipe 75. The cycle repeats in a continuous loop as the working fluid 95 absorbs heat from the hot exhaust 15 and transfers that heat to the fresh makeup air 55 resulting in heated makeup air 110 as depicted in FIG. 2A.

The temperature of the heated makeup air 110 may be modulated by altering the position of a bypass damper 105 mounted within the supply chamber 60 of the kitchen hood 5. This damper 105 may be manually adjusted or it may be linked to an actuator 120 that rotates one or more blades within the damper 105 to an open, closed or intermediate position.

A microprocessor connected to the existing kitchen HVAC system, may be used to sense the temperature in the post-mixing chamber 135 and the temperature in the supply chamber 60, comparing these temperatures to the operating temperature selected by the user. An output signal from the microprocessor may be sent to the actuator 120, rotating the blade or blades to shift the airstream over the energy recovery module 70 and thereby changing the temperature of the heated makeup air 110.

FIG. 2A shows the bypass damper 105 in the closed or winter position. In this drawing, fresh makeup air 55 is directed over the condensation ends 90 of the heat pipes 75 in each energy recovery module 70, allowing heat transfer from the heat pipes 75 to the fresh makeup air 55.

FIG. 2B illustrates the bypass damper 105 in its open or summer position. Here, the fresh makeup air 55 is diverted to bypass the energy recovery modules 70. In this configuration, the airstream is prevented from contacting the condensation ends 90 of the heat pipes 75 thereby preventing heat transfer and directing non-heated makeup air 55 to the kitchen.

It should be recognized that the bypass damper 105 may be in any intermediate position between the open and closed configurations depicted in FIGS. 2A and 2B, allowing for modulation of the makeup air temperature as described above.

As noted above, the energy recovery modules 70 are comprised of a plurality of heat pipes 75. Each heat pipe 75 is typically made of a conductive metal such as copper and filled with a small amount of working fluid such as water or other suitable refrigerants. The heat pipe 75 is then pressurized and hermetically sealed at both ends. Inventors anticipate the use of copper heat pipes 75 filled with R-134 or water; however, any suitable metal pipes and working fluid may be employed, provided that the fluid is pressurized to provide a boiling point between 80° F.-100° F. Typically the heat pipes 75 will be three-eighths inch to five eighths inch in diameter and approximately twenty to thirty-six inches in length; however, it should be recognized that any diameter and length of pipe may be used provided that it fits within a kitchen hood and provides the required heat transfer.

Heat pipes 75 are placed substantially parallel to each other and housed within a container or frame. At least one sliding door or hinged access panel 145 is added to at least one face of the kitchen hood 5. This door or sliding panel 145 may be solid or alternatively, it may be perforated to act as a diffuser. Multiple doors may also be used to access individual modules. Supporting means 150 such as tracks or t-brackets, depicted in FIG. 6, may be installed within the kitchen hood 5 to hold each energy recovery module 70 and allow for easy installation and removal.

The module installation angle α of the heat pipes 75 plays a significant role in the efficiency of the energy recovery module 70. Generally speaking a heat pipe 75 is most efficient when operating at an angle between 30° and 60° from the horizontal plane; however the heat pipe 75 will be still be operational from 0° to 90°. The energy recovery modules 70 may be positioned such that they are parallel to angle of the installed filter 25 provided that the heat pipes 75 operate at the required efficiency. Alternatively, the energy recovery modules 70 may be placed at any point within the kitchen hood 5 provided that they are located above the filter 25 such that the evaporation end 85 sits within the hot exhaust air stream 15 and the condensation end 90 sits within the makeup air stream 55. The module installation angle α in this scenario will be limited only by the size and geometry of the kitchen hood 5 and energy recovery modules 70. It should be recognized that the energy recovery module 70 may also be bent allowing for one module installation angle α on the evaporation end and a second angle at the condensation end 90 as further discussed below.

FIG. 4 depicts two rows of four modules 70, each row being stacked uniformly on top of one another; however, it should be understood that the modules 70 need not have a uniform size nor do they need to be uniformly stacked.

Figure 5:
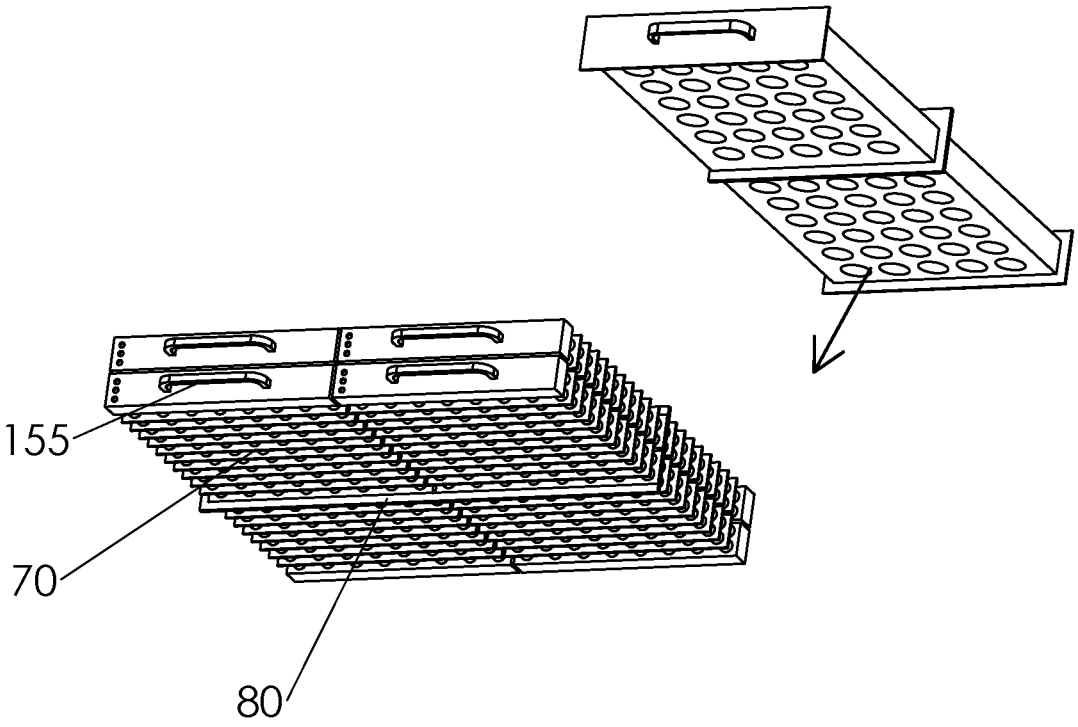
FIG. 5 is a perspective view of a plurality of energy recovery modules and having a dummy coil
Figure 6:
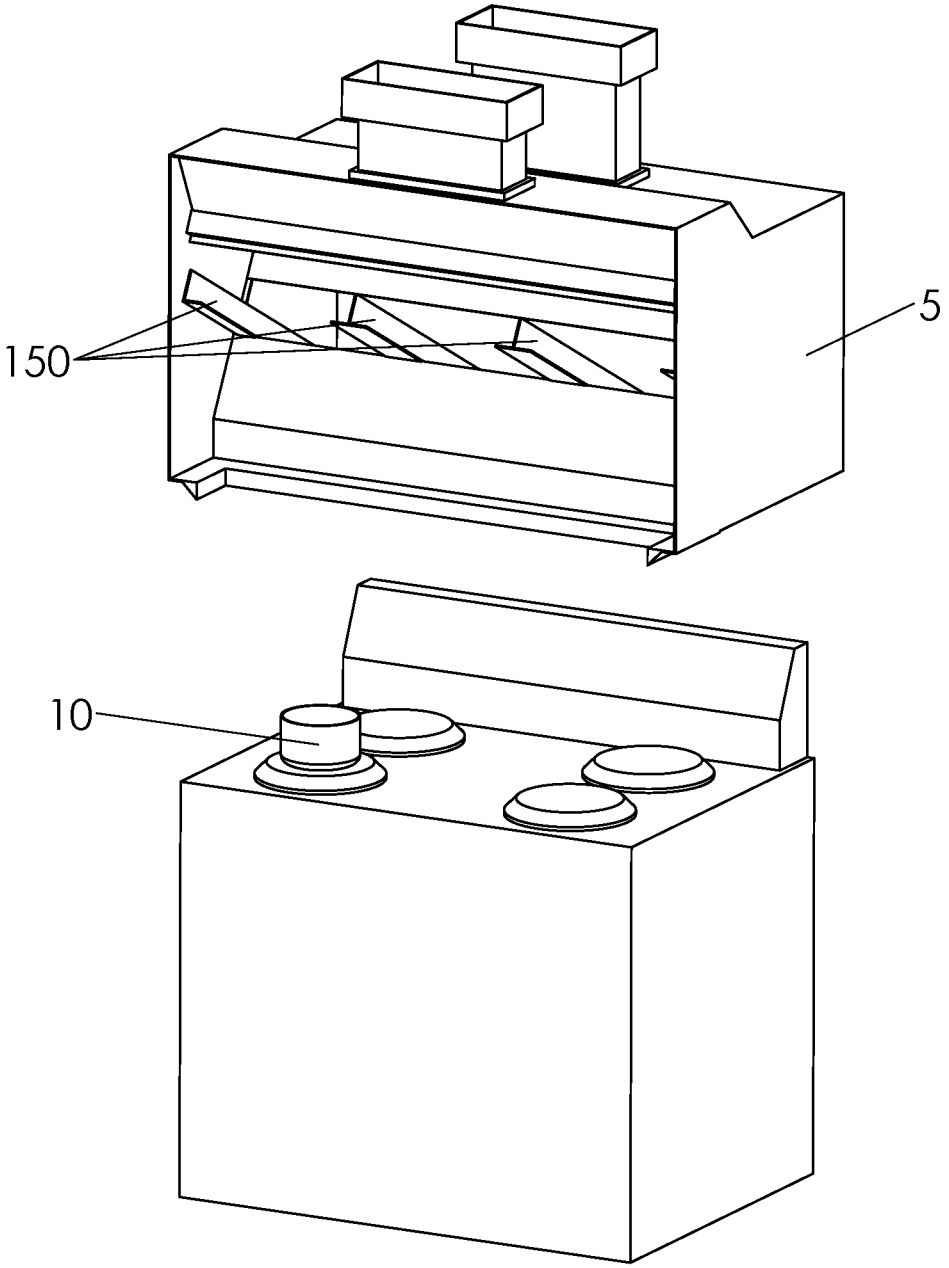
FIG. 6 is a perspective view of a kitchen hood having t-brackets to support the energy recovery modules
Figure 7A:
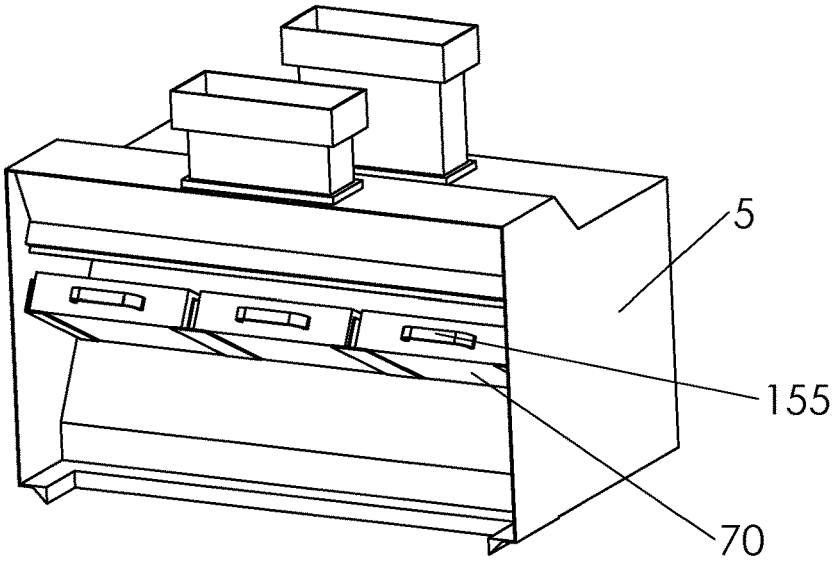
FIG. 7A is a perspective view of the present invention showing a configuration of three energy recovery modules installed within a standard commercial kitchen hood, each module having optional handles
Figure 7B:
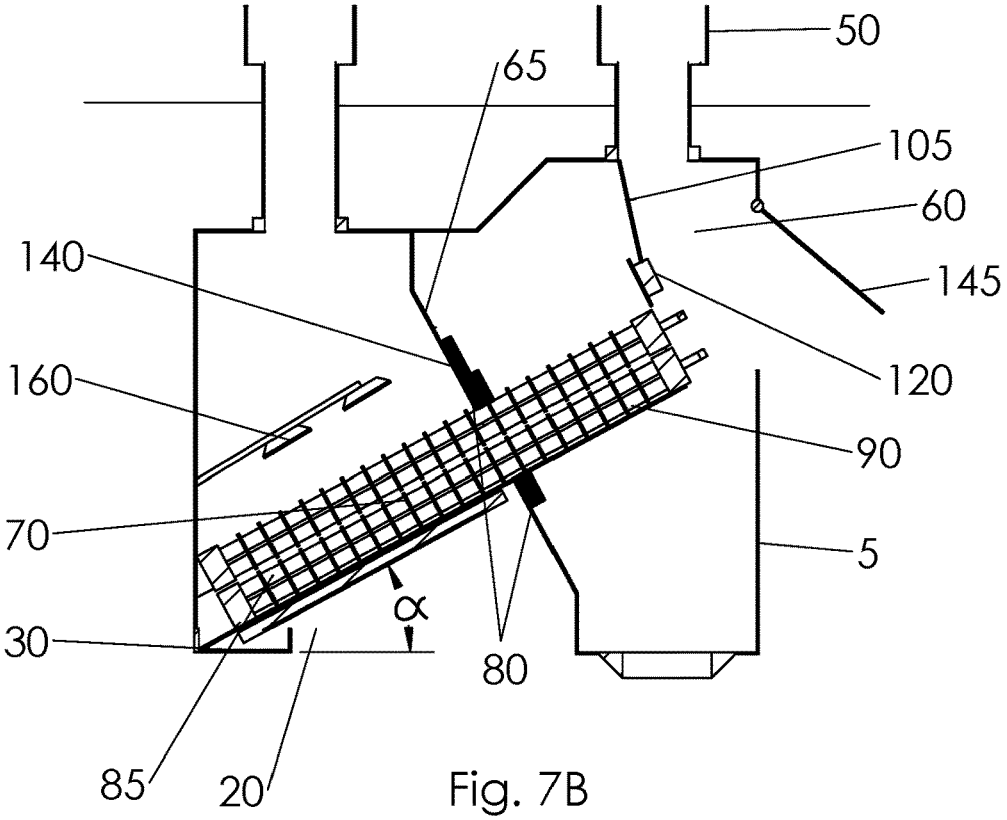
FIG. 7B is an elevational side view of the present invention depicting the access door in its open position
Figure 8:
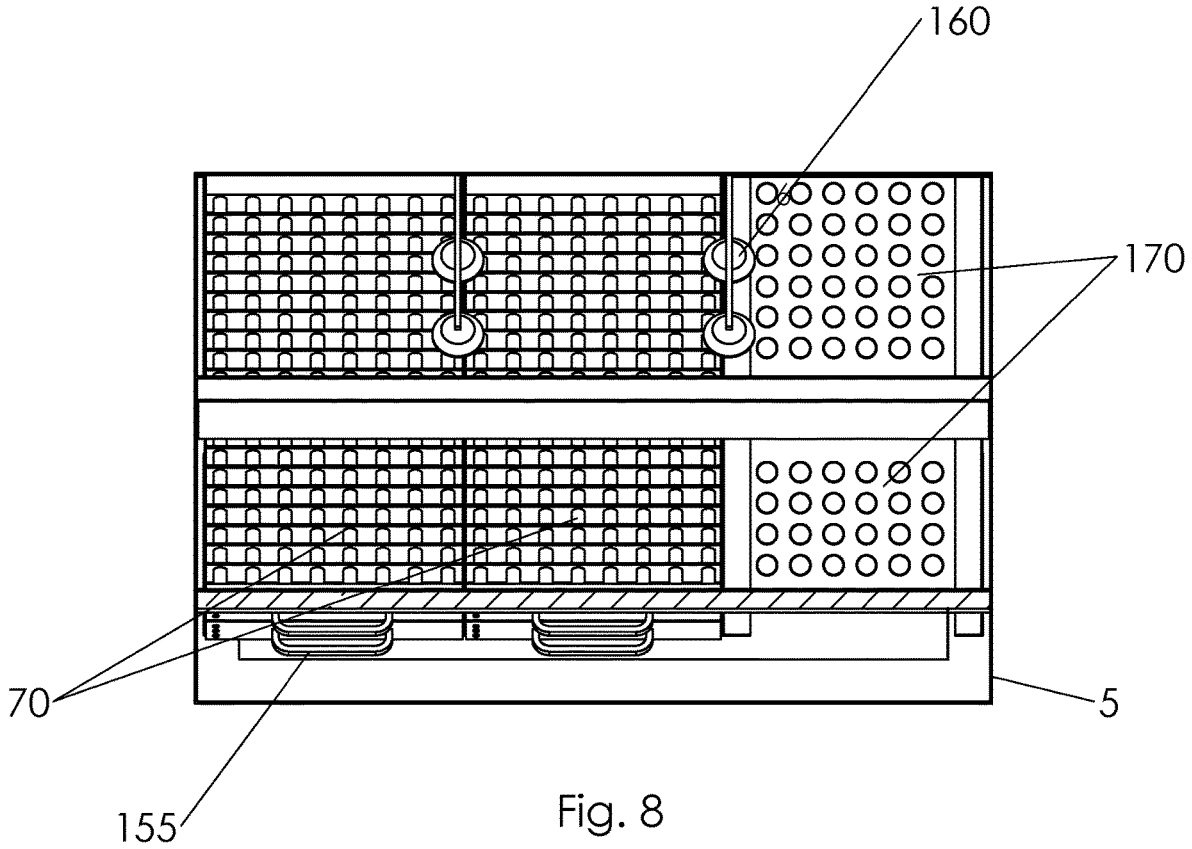
FIG. 8 is a top view of the present invention illustrating spray nozzles above a configuration of two energy recovery modules and a dummy coil installed within a standard commercial hood

Even though the evaporation end 85 is positioned within filtered air 45, grease will inevitably collect on the heat pipes 75. The energy recovery module 70 must therefore be periodically cleaned or the efficiency of heat transfer will be compromised. In order to promote ease of cleaning, a number of small energy recovery modules 70 may be installed within an existing kitchen hood 5. While any size may be used, ideally each module 70 will be approximately twelve inches wide and twenty-four inches high, having a handle 155 at each end as shown in FIGS. 4, 5 and 7A. Looking now to FIGS. 6, 7A and 7B, when cleaning is required, the user may open the sliding door or access panel 145, grab onto the handle 155, and remove the energy recovery module 70 by sliding it along the supporting means 150 and through the open sliding door or hinged access panel 145 shown in FIG. 7B. The module 70 can then be hand or machine washed and replaced.

Optional spray nozzles 160, depicted in FIGS. 2A, 2B, 7B and 8 may already be present within the existing kitchen hood 5 or may be added during a retrofit. These spray nozzles 160 can be used to clean the energy recovery modules 70 as well as the filter 25. This reduces or eliminates the need to remove the energy recovery modules 70 and would allow for the possibility of one large energy recovery module 70 instead of a plurality of smaller, more easily removeable modules.

In the event that a full array of modules 70 is not used due to budget or heating requirements, a dummy coil 170 may be installed to maintain the proper pressure differentials between the hot exhaust 15 and fresh makeup air 55 as shown in FIG. 5. The dummy coil 170 is made in the general size and shape of the energy recovery module and is fitted with inexpensive perforated panels to restrict the airflow, creating the required air pressure as depicted in FIG. 5 and FIG. 6.

Figure 9A:
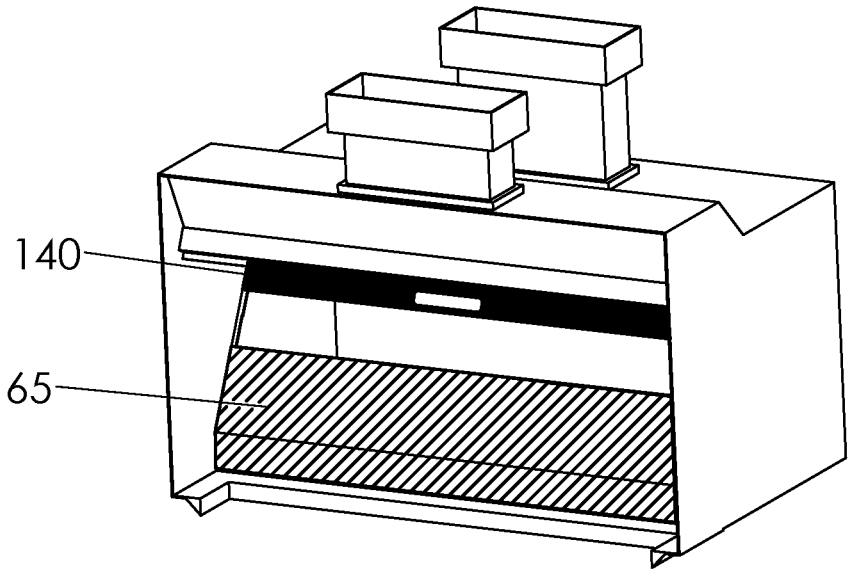
FIG. 9A is a perspective view of the baffle door in the open position
Figure 9B:
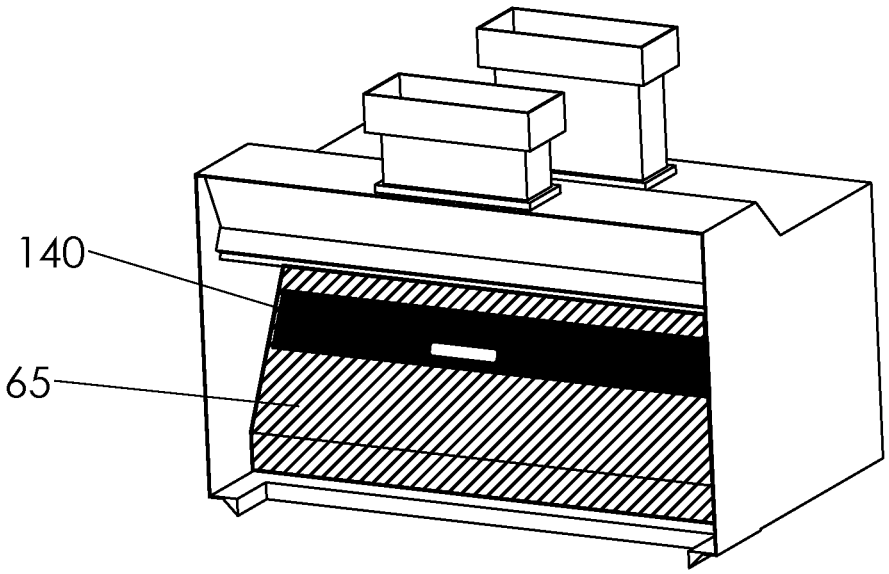
FIG. 9B is a perspective view of the baffle door in the closed position

If the energy recovery modules 70 are removed for maintenance or if the user wishes to install the modules 70 at a later date, a baffle door 140 may be placed in front of the void as shown in FIGS. 9A and 9B to create a continuous baffle 65. This will allow the unit to be operated without the modules 70, ensuring the hot exhaust 15 and fresh makeup air 55 streams do not mix. This baffle door 140 may slide over the baffle 65 or may be held in place with magnets or mechanical fastening means.

Figure 10:
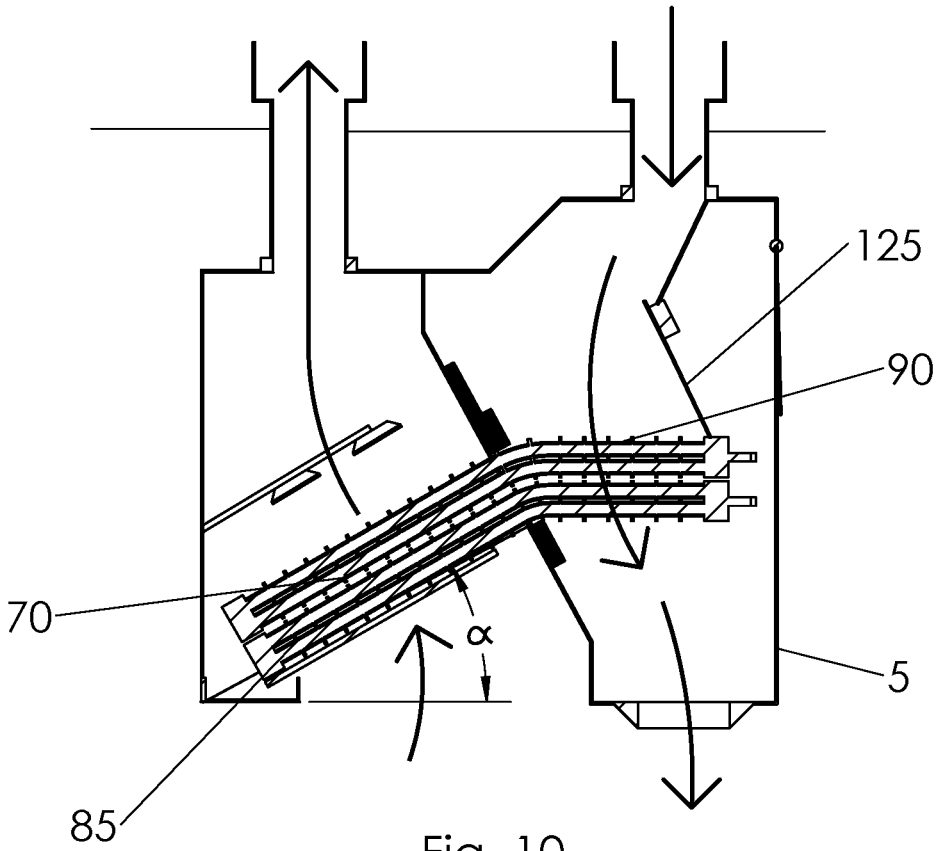
FIG. 10 is an elevational side view of an energy recovery module having one module installation angle on the evaporation end and a second module installation angle on the condensation end

There may be instances where spatial limitations prevent the installation of an energy recovery module 70 having a single module installation angle α. Kitchens with low ceiling heights or inaccessible hood side panels may require modules having different module installation angles α on the evaporation end 85 and condensation end 90 as depicted in FIG. 10. In this figure, the condensation end 90 is placed at an angle of 0°; however, as previously discussed this angle of the evaporation end 85 can range anywhere from 0° to 90° from the horizontal plane provided that the energy recovery module 70 fits within the spatial constraints of the given application. A reduction in the module installation angle α at the condensation end 90 allows for easier installation in confined spaces. In such a case, the damper blade 105 would be modified to create the required seal to control airflow of the fresh makeup air 55 through the addition of a moveable partition 125. The supporting means 150 may also be altered to allow for easy removal and installation of the unit.

While the above description contains many specifics, these should be considered exemplifications of one or more embodiments rather than limitations on the scope of the invention. As previously discussed, many variations are possible and the scope of the invention should not be restricted by the examples illustrated herein.

The invention claimed is:

1. A ventilation hood for use with heat generating equipment comprising:

an exhaust passage for exhausting air from the vicinity of the equipment;

a supply passage for supplying fresh makeup air to the equipment;

a baffle for segregating the exhaust passage from the supply passage, the baffle having a void;

a filter means disposed in said exhaust passage for removing particulate matter and residue from the exhausting air;

at least one energy recovery module comprised of a plurality of heat pipes arranged in a substantially parallel configuration, the energy recovery module having an evaporation end and a condensation end, wherein the energy recovery module is positioned through the void in the baffle such that the evaporation end is disposed in said exhaust passage and the condensation end is disposed in said supply passage, downstream of the exhausting air, and the ventilation hood further comprising:

a temperature selection means;

at least one bypass damper disposed in said supply passage;

a first temperature sensing means disposed within said supply passage downstream of the energy recovery module;

a second temperature sensing means disposed within said exhaust passage and upstream of the energy recovery module;

a processing means to calculate the temperature differential between the first and second temperature sensing means and subsequently calculate the ideal position of said damper blade to provide the selected temperature; and a means to change the position of the bypass damper to provide the selected temperature.

2. The device of claim 1, wherein said energy recovery device module is installed at an angle ranging from 10 to 80 degrees from the horizontal plane.

3. The device of claim 1, wherein said evaporation end is installed at an angle ranging from 0 to 90 degrees from the horizontal plane and said condensation end is installed at an angle ranging from 10 to 80 degrees from the horizontal plane.

4. The device of claim 1, further comprising a dummy coil to balance the exhaust passage and the supply passage pressures.

5. The device of claim 1, further comprising spray nozzles to aid in cleaning the energy recovery module and filter.

6. The device of claim 1, wherein the heat pipes are comprised of a conductive metal and are filled with a working fluid that is pressurized to provide a boiling point ranging from 80° F.-100° F.

7. The device of claim 1, wherein the energy recovery module further comprises a handle.

8. A ventilation hood for use with heat generating equipment comprising:

an exhaust passage for exhausting air from the vicinity of the equipment;

a supply passage for supplying fresh makeup air to the equipment;

a baffle for segregating the exhaust passage from the supply passage, the baffle having a void;

a filter means disposed in said exhaust passage for removing particulate matter and residue from the exhausting air;

at least one easily removeable and easily exchangeable energy recovery module comprised of a plurality of heat pipes arranged in a substantially parallel configuration, the energy recovery module having an evaporation end and a condensation end, wherein the energy recovery module is positioned through the void in the baffle such that the evaporation end is disposed in said exhaust passage and the condensation end is disposed in said supply passage, downstream of the exhausting air, and the ventilation hood further comprising:

a temperature selection means;

at least one bypass damper disposed in said supply passage;

a first temperature sensing means disposed within said supply passage downstream of the energy recovery module;

a second temperature sensing means disposed within said exhaust passage and upstream of the energy recovery module;

a processing means to calculate the temperature differential between the first and second temperature sensing means and subsequently calculate the ideal position of said damper blade to provide the selected temperature; and a means to change the position of the bypass damper to provide the selected temperature.

9. A method for retrofitting an existing ventilation hood for use with heat generating equipment, the ventilation hood having a supply passage, an exhaust passage, and a baffle to segregate the supply passage from the exhaust passage, the method comprising the steps of:

installing an access panel within the ventilation hood;

creating a void in the baffle sized to accommodate one or more easily removeable and exchangeable energy recovery modules, wherein each energy recovery module is comprised of a plurality of heat pipes arranged in a substantially parallel configuration, the energy recovery module having an evaporation end and a condensation end;

installing a support means within the supply passage and exhaust passage; and positioning the energy recovery module within the support means and through the baffle void such that the evaporation end of the recovery module is disposed within the exhaust passage and the condensation end is disposed within the supply passage, and the method further comprising the steps of:

installing a temperature selection means;

installing at least one bypass damper disposed in said supply passage;

installing a first temperature sensing means disposed within said supply passage downstream of the energy recovery device;

installing a second temperature sensing means disposed within said exhaust passage;

installing a processing means to calculate the temperature differential between the first and second temperature sensing means and subsequently calculate the ideal position for said damper blade to provide the selected temperature; and installing a means to change the position of the bypass damper to provide the selected temperature.

* * * * *